US010947022B2

(12) United States Patent
Zelenak et al.

(10) Patent No.: US 10,947,022 B2
(45) Date of Patent: Mar. 16, 2021

(54) INTEGRATED CARTON AND SHIPPING CONTAINER DESIGN AND FILLING MANUFACTURE PROCESS

(71) Applicant: KIMBERLY-CLARK WORLDWIDE, INC., Neenah, WI (US)

(72) Inventors: Robert J. Zelenak, Appleton, WI (US); Jason J. Schumaker, Hortonville, WI (US); Brandon M. Hokanson, Sheboygan Falls, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/332,410

(22) PCT Filed: Mar. 13, 2018

(86) PCT No.: PCT/US2018/022155

§ 371 (c)(1),
(2) Date: Mar. 12, 2019

(87) PCT Pub. No.: WO2018/182966

PCT Pub. Date: Oct. 4, 2018

(65) Prior Publication Data

US 2019/0375567 A1 Dec. 12, 2019

Related U.S. Application Data

(60) Provisional application No. 62/478,999, filed on Mar. 30, 2017.

(51) Int. Cl.
*B65D 77/04* (2006.01)
*B65B 5/06* (2006.01)
(Continued)

(52) U.S. Cl.
CPC ..... *B65D 77/042* (2013.01); *B65B 5/06* (2013.01); *B65B 7/20* (2013.01); *B65B 25/141* (2013.01);
(Continued)

(58) Field of Classification Search
CPC .... B65D 5/06; B65D 5/5495; B65D 5/48024; B65D 77/042; B65D 2577/043; B65B 5/06; B65B 2220/16
(Continued)

(56) References Cited

U.S. PATENT DOCUMENTS 1,971,863 A * 8/1934 Lupton ..... B65D 5/326 229/117.06
2,617,576 A * 11/1952 Bergstein ..... B65D 5/4804 229/117.06
(Continued)

FOREIGN PATENT DOCUMENTS

WO WO2015116752 8/2015

OTHER PUBLICATIONS

International Search Report for PCT/US2018/022155, dated Jun. 27, 2018, 12 pages.

*Primary Examiner* — Nathan J Newhouse
*Assistant Examiner* — Phillip D Schmidt
(74) *Attorney, Agent, or Firm* — Dority & Manning, P.A.

(57) ABSTRACT

An integrated carton and container which includes a collapsible container and a plurality of cartons. The carton or cartons can be filled with a product or products while the carton or cartons remain integrated with the container. The carton and container are integrated in such a way that when the container is expanded into an open position, the carton or cartons correspondingly expand into an open position. The integrated carton and container may be integrated in
(Continued)

such a way that the integrated carton and container may be filled with a product and closed on a single apparatus.

20 Claims, 10 Drawing Sheets

(51) Int. Cl.
*B65B 7/20* (2006.01)
*B65B 25/14* (2006.01)
*B65B 43/18* (2006.01)
*B65D 5/36* (2006.01)

(52) U.S. Cl.
CPC ..... *B65B 43/185* (2013.01); *B65D 5/36* (2013.01); *B65B 2220/16* (2013.01); *B65D 2577/043* (2013.01)

(58) Field of Classification Search
USPC ..... 53/376.4–377.3, 467–468, 170–173, 286
See application file for complete search history.

(56) References Cited

U.S. PATENT DOCUMENTS 4,021,966 A * 5/1977 Rimpinen ..... B65D 5/3628 47/86
4,242,161 A * 12/1980 Hulten ..... B31B 50/00 156/197
4,633,655 A * 1/1987 Nigrelli, Sr. ..... B65B 5/024 53/252
4,815,253 A * 3/1989 Kovacs ..... B65B 9/213 493/319
5,911,323 A * 6/1999 Bapst ..... B65D 77/042 206/446
2003/0080125 A1 5/2003 Cassani
2006/0163335 A1* 7/2006 Pokusa ..... B65B 5/024 229/136
2008/0283535 A1 11/2008 Westrate et al.
2011/0240646 A1* 10/2011 Thomas ..... B65D 5/0236 220/276
2015/0076199 A1 3/2015 Granvle

* cited by examiner

INTEGRATED CARTON AND SHIPPING CONTAINER DESIGN AND FILLING MANUFACTURE PROCESS

CROSS REFERENCE TO RELATED APPLICATIONS

This application is the U.S. National Stage entry of International Application Number PCT/US2018/022155 filed under the Patent Cooperation Treaty having a filing date of Mar. 13, 2018, which claims priority to U.S. Provisional Patent Application No. 62/478,999 having a filing date of Mar. 30, 2017, which are incorporated herein by reference.

BACKGROUND

Many packaged products currently utilize a carton in a case arrangement for shipment, storage, and display. This method is used extensively as it allows products sized and shaped for individual sale to be stored and shipped in a single container. This arrangement may provide additional benefits such as protection, organization, compactability, and stackability without needing to alter the product packaging itself.

For example, cartons may contain paper products, hygiene products, incontinence products, cleaning products, or any other product that may be contained in a carton or similar container. The cartons are designed for individual sale and use such that it would be undesirable to add additional packaging to make them suitable for commercial shipment or storage. Instead, the cartons may be oriented in a larger container which is designed to withstand shipping and/or storage, or may be designed to display the products upon arrival at a retailer.

Additional benefits of the carton in a container method include space saving attributed to fewer and more uniform containers. By placing cartons, some of which may have various shapes depending on the product, into containers made for shipping or storage, stackability may be increased as well as compactability. Less containers and more uniform containers allows for increased space-use efficiency as well as potential increased efficiency in loading, unloading, shipping and storage.

The problem faced by many using a carton in a case method is that it requires two stand-alone machines. One machine fills cartons with various products, and then filled cartons need to be reoriented before proceeding to a second machine where cases are packed. This two-step process has low operational efficiencies through high processing time, high waste and delay, as well as high material and labor costs.

Additional problems faced by the carton in a case method include inefficient packing. Inefficiently packed cartons may move about within the case during transit leading to damaged product or packaging. This problem may be compounded by cases or containers which are difficult to open. Cases which are difficult to open may lead to additional damage as well as unpacking inefficiencies, particularly if a product has shifted during transit, often leading to a need for reorganization such as restacking or repacking.

As there are many benefits with continuing to use a carton in case arrangement, there exists a need to provide integrated containers or cases which are pre-formed to contain a plurality of cartons which may have various shapes, sizes, and arrangements. There also exists a need to provide an integrated carton and container which may be filled using a single apparatus. There would also be benefit in providing an integrated container and carton in which the cartons and container may be filled and sealed using a single apparatus. Similarly, it would be beneficial to provide a product or method which decreases the amount of time, materials, or space needed to fill a carton and pack a container. There is also a need to provide integrated containers which are pre-formed with a plurality of cartons such that an interior volume of the container is filled with the cartons in an efficient manner which may minimize shifting and increase packing efficiency. A further need may be to provide an integrated case and carton which may be easily opened.

SUMMARY

In general, the present disclosure is directed to an integrated carton and container comprising a collapsible container. The collapsible container may have sidewalls, a first end and an opposite second end. The collapsible container may also define an interior volume and comprise a plurality of collapsible cartons. Each carton may have at least one sidewall, a first end and an opposite second end. Each carton may have a folded position and an open position, wherein the folded position may be substantially flat and the open position may be an expanded position defining an interior volume.

The plurality of collapsible cartons may be arranged and positioned in the interior volume of the container such that the at least one sidewall of each carton is parallel with at least one of the sidewalls of the container. At least some of the cartons may be releasably attached to the container or to an adjacent carton in a manner that integrates the cartons to the container such that when the container is in a collapsed position, all of the cartons are in the folded position and when the container is transitioned from the collapsed position to an open position, all of the cartons similarly transition from the folded position to the open position. The second end of each carton may be configured to close automatically when the container is transitioned from the collapsed position to an open position.

An integrated carton and container of the present disclosure may have cartons which are positioned within the container such that the first end of every carton faces the first end of the container. The integrated carton and container may further have an arrangement wherein there are at least two rows of cartons and two columns of cartons. In a further embodiment, the integrated carton and container may have an arrangement wherein there are at least three rows of cartons and three columns of cartons. Each carton may also have flaps that close each carton and the container may have flaps that close the container.

An integrated carton and container of the present disclosure may have at least one point of releasable attachment between every carton and the container or an adjacent carton. For every carton that is adjacent to a container sidewall, the at least one point of releasable attachment may be to a container sidewall. In one embodiment, the container has a first sidewall and an opposed second sidewall, and each carton has a first sidewall and an opposed second sidewall, and each carton has two points of releasable attachment. A first point of releasable attachment may be between the first sidewall of a carton and the first sidewall of the container or the second sidewall of an adjacent carton. The second point of releasable attachment may be between the second sidewall of a carton and the second sidewall of the container or the first sidewall of an adjacent carton.

An integrated carton and container of the present disclosure may further comprise a second plurality of collapsible cartons positioned within the container. Each of the cartons in the second plurality include at least one sidewall, a first end, and a second and opposite end. The second end of the first plurality of cartons faces the second end of the second plurality of cartons within the container such that the first end of each carton in the second plurality of cartons faces the second end of the container. The second end of each carton in the first or second plurality may be configured to close automatically when the container is transitioned from the collapsed position to an open position.

The present disclosure may further include a method for filling and closing an integrated carton and container. The method may include placing an integrated carton and container on a case assembly apparatus and holding the container and carton or cartons in an open position. Filling some or all of the cartons with a product or products, closing the carton or cartons, and closing the container. A container leading side minor flap and container trailing side minor flap may be held in an open position with a releasable attachment mechanism. In yet a further embodiment, guide bars may be used to hold container major flaps and carton major flaps in an open position, and then using guide bar transitions, close the container and carton major flaps.

A carton leading side minor flap may contain a notch which is sized and positioned to correspond with a closing mechanism to allow the closing mechanism to pass through the notch, leaving the carton leading side minor flap in an open position. The closing mechanism may close the carton trailing side minor flap. After the carton trailing side minor flap has been closed, then the carton leading side minor flap may be closed by the same or different closing mechanism.

The method for closing an integrated carton and container may comprise filling the integrated carton and container with a side load mechanism or by a top load mechanism. A side load mechanism may fill the integrated carton and container from a first end, an opposed second end, or both ends. This method may be used when more than one plurality of cartons are arranged in the container.

In a further embodiment, the integrated carton and container may be filled with products that comprise facial tissues or feminine care products.

BRIEF DESCRIPTION OF THE DRAWINGS

The invention will now be described, by way of example, with reference to the accompanying drawings, in which.

DETAILED DESCRIPTION

Figure 1:
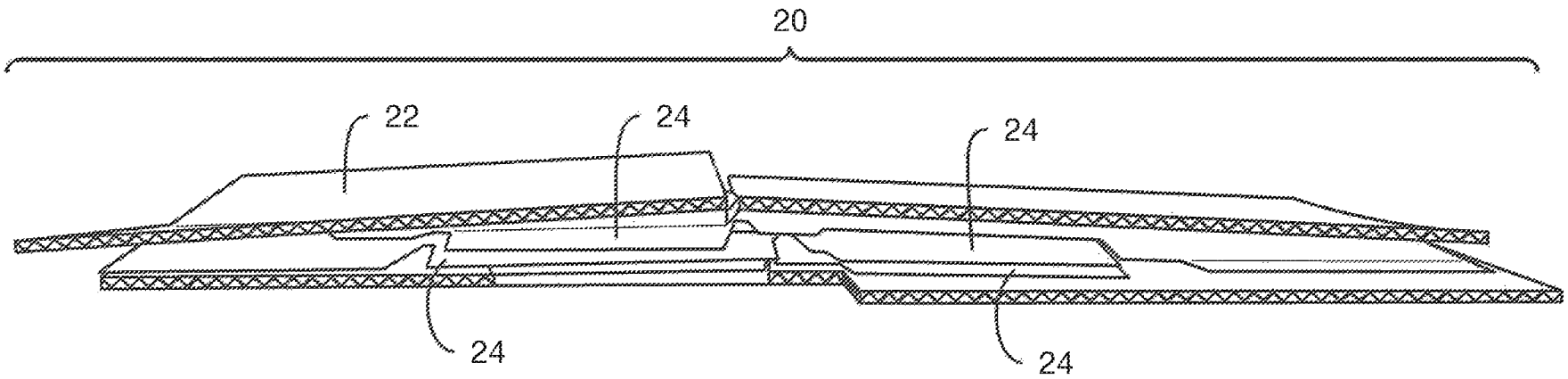
FIG. 1 is a view of an integrated carton and container in a semi-flat position.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

The present disclosure is generally directed to an integrated carton and container. An integrated carton and container of the present disclosure may contain a plurality of cartons which have been releasably integrated into a collapsible container. The cartons may generally fill an interior volume of the container and may be integrated in such a way that the cartons may be in a folded position when the container is in a collapsed position and may be expand from the folded position into an open position when the container is expanded into an open position. The cartons may further be integrated in a way that they remain in an open position during processing so that they may receive a product while remaining integrated with the container.

The integrated carton and container of the present disclosure may also generally be directed to cartons releasably integrated into a container which have a flap configuration that allows the carton flaps to be closed by an apparatus, which may be a combined fill and closure apparatus.

The present disclosure may also generally be directed to a method for filling and closing an integrated carton and container such that the entire process may be completed on a single apparatus. Integrated cartons and containers may be placed on a combined filling and closing apparatus such that the cartons are filled with a product and both carton and container flaps are closed on the same apparatus.

A filling apparatus for filling an integrated carton and container may further be generally disclosed. A filling apparatus for filling an integrated carton and container may contain a plurality of interior and exterior guide bars so as to restrain both carton and container flaps. A filling apparatus for filling an integrated carton and container may also contain a secondary restraining mechanism, such as fingers or clips to restrain some or all of the carton and/or container flaps. A filling apparatus for filling an integrated carton and container may further generally contain a multi-tiered packer which is configured to hold a plurality of products and place the products into cartons.

Figure 3:
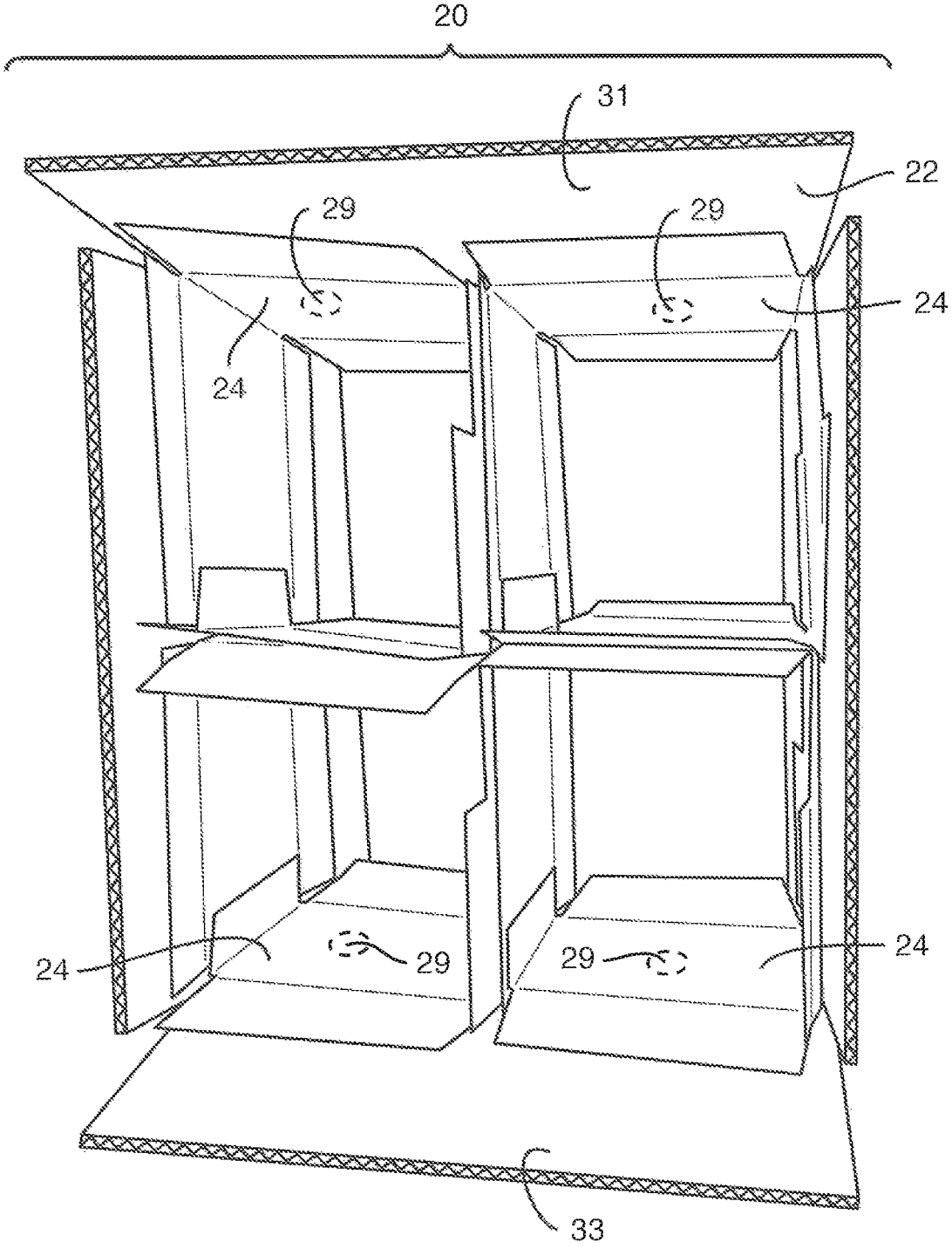
FIG. 3 is a view of an integrated carton and container in an open position.

The integrated carton and container of the present disclosure may have an embodiment such as the embodiment generally portrayed in FIG. 3. However, FIG. 3 is not intended to limit the present disclosure, and alternative embodiments may include a larger number of cartons or a smaller number of cartons. While FIG. 3 portrays an embodiment which contains cartons having a square cross section, an alternative embodiment may include cartons having a rectangular or other quadrilateral, triangular, ovalular, or circular cross sections, as well as other cross sections generally used in the field.

As shown in FIG. 3, an embodiment may generally include a carton and a container which each have four sidewalls and a first end and a second opposed end. The first and second ends may be open as portrayed in FIG. 3, or alternatively, the cartons and/or the containers may have one open end and one closed end. Each of the ends may have projections which extend from one end or both ends and may generally be delineated by a perforation or pre-folded area. These projections may be folded in on one or both ends to enclose the open ends of the cartons or container. In one embodiment, the projections used to close the carton or container may be flaps.

While the cartons and container may be formed according to this embodiment, any form known in the field may be used to produce cartons and containers. Further, known methods may be used to produce cartons and containers which may be substantially flat in one position and which may open into a cross section as discussed above. Additionally, other known forms for closing an end or ends of a carton or containers may be used, or alternatively cartons or containers may be used which only have a single open end.

Cartons of the present disclosure may be integrated into the container such that the first end of a carton faces the first end of a container. In this manner, container flaps and carton flaps may also extend in a substantially similar direction. Cartons may be arranged in the container in at least two rows, such as at least three rows, such as at least four rows, such as at least five rows, such as at least six rows, such as at least eight rows, such as at least ten rows, such as less than twenty rows, such as less than fifteen rows, such as less than twelve rows, such as less than ten rows. Cartons may also be arranged in the container in at least two columns, such as at least three columns, such as at least four columns, such as at least five columns, such as at least six columns, such as at least eight columns, such as at least ten columns, such as less than twenty columns, such as less than fifteen columns, such as less than twelve columns, such as less than ten columns. The number of columns and rows may be selected in any combination of the above.

In an alternate embodiment, a second plurality of cartons are integrated within the container. The second plurality of cartons having at least one sidewall, a first end, and a second opposite end. The second plurality of cartons may be arranged such that the second end of the first plurality of cartons faces the second end of the second plurality of cartons within the container. In this way, the first end of the second plurality of cartons may face the second end of the container. Cartons in the second plurality may be arranged in the container in at least two rows, such as at least three rows, such as at least four rows, such as at least five rows, such as at least six rows, such as at least eight rows, such as at least ten rows, such as less than twenty rows, such as less than fifteen rows, such as less than twelve rows, such as less than ten rows. Cartons may also be arranged in the container in at least two columns, such as at least three columns, such as at least four columns, such as at least five columns, such as at least six columns, such as at least eight columns, such as at least ten columns, such as less than twenty columns, such as less than fifteen columns, such as less than twelve columns, such as less than ten columns. The number of columns and rows may be selected in any combination of the above, and may be arranged in the same manner and number as the first plurality of cartons.

Cartons of the present disclosure may be releasably attached to one or multiple other cartons, or alternatively all or some cartons may be releasably attached to the container. In a further embodiment, none of the cartons may be attached to another carton or alternatively none of the cartons may be attached to the container. In yet a further embodiment, the cartons may not be attached to any other cartons and instead may be arranged spatially to support one another or be arranged within an internal support. In another embodiment, cartons may be further subdivided such that individual cartons may include several sub-cartons. Alternatively, cartons may be grouped, either permanently or releasable, to one or multiple other cartons.

Specifically, cartons may be attached to an adjacent carton or the container at a point of to releasable attachment. A point of releasable attachment may be an area where a releasable attachment composition or a releasable attachment mechanism has been applied or affixed to a carton or a container. A point of releasable attachment may be located on an interior portion of a container sidewall and an exterior portion of a carton sidewall such that the point of attachment is either between a carton sidewall and a container sidewall or between two carton sidewalls.

A container may have multiple points of attachment, such as a single point of attachment for each carton that the container is adjacent to, multiple points of attachment for each carton that the container is adjacent to, or may only have attachment points for a portion of the cartons that the container is adjacent to. In one embodiment, a container may only have attachment points at a first sidewall and an opposed second sidewall, and no points of attachment on the other sidewalls.

A carton may have multiple points of attachment, no points of attachment or a single point of attachment. A carton may only have a point or points of attachment to a container, or may have a point or points of attachment to only a carton, or may have points of attachment to both a carton and a container. In one embodiment, cartons may only have a point or points of attachment to adjacent cartons in the same row, in an alternate embodiment, cartons may only have a point of attachment to an adjacent carton in the same column. In an embodiment where cartons are only attached in a single row or column, the attachment, if any, to the container may be to cartons at the ends of the row or column. In such an arrangement, cartons would only be attached to the container at a first container sidewall and an opposed second container sidewall, so as to maintain attachment orientation of only within the same column or same row.

A point of attachment may be positioned spatially in any location on the sidewall of the desired carton or container. For example, in one embodiment the point of attachment may be substantially centered on a sidewall or may be near any edge of the sidewall. The spatial location does not need to be identical or even similar from carton to carton or carton to container. A point of attachment between two cartons may be substantially centered, and a point of attachment between the one of the previous cartons and an adjacent carton on an opposite side may be off centered or below or above the substantially centered point of attachment. In one embodiment, a spatial variation of attachment points may be used in a manner that further stabilizes the integrated carton and container.

A releasable attachment composition or mechanism may be any releasable attachment composition or mechanism known in the field. A non-inclusive list for example may be adhesives or co-adhesives such as fugitive glue, or other tacky substances. Any number of suitable and commercially available adhesives or tacky substances may be used in this regard, and the adhesive material or tacky substance may have adhesive and release characteristics to ensure that a carton may remain in place but can be removed without being damaged when the container is opened or unpacked.

Integrated carton and containers may also utilize an opening and separation mechanism such as a container with a strip either integrated into the container or a strip located between the container and cartons which may be releasably attached to both the container and some or all of the cartons. A strip integrated into the container may be a perforated strip which may have a tab that can be grasped and pulled along the perforation, completely separating the strip from the container and separating the container into two pieces above and below the strip. In a further embodiment the container may have more than one such strip, dividing the container into more than two pieces. In yet a further embodiment the cartons may be releasably attached to the interior portion of the container which corresponds to the strip such that when the strip is removed, the releasable attachment composition is also removed or separated. Similarly, in an alternative embodiment, more than one row of cartons may be used and each row may be attached to a separate strip.

In a further embodiment, the releasable strip may generally be located between the cartons and the container in the interior of the container and may be releasably attached to some or all of the cartons and the container. In such an embodiment, the strip may be accessible when the container is opened, either by an extended side portion or other similar methods. The strip, when pulled may separate from both the carton or cartons and the container and may also remove the adhesive composition such that the cartons may now be separated from the releasable attachment composition.

Generally, a container for use in the present disclosure may define an internal volume which decreases when the container is collapsed towards a closed position. Cartons may be arranged in the interior volume so as to fill the interior volume. In one embodiment, cartons may be arranged in a highly efficient manner such that substantially all of the interior volume is filled by the cartons. In another embodiment, the cartons may not fill all of the volume, or a small amount of volume may be left unfilled by the cartons. Interior volume that remains unused by the cartons may be filled with additional packaging or cushioning materials, heat or cold resistant or insulating materials, display or decorative materials, or other similar packaging materials. Volume unused by the cartons may be along the outer edge or may be located between cartons. Alternatively, volume unused by the cartons may be between some cartons but not all of the cartons or may be located between some or all of the cartons and some or all of the container. Materials used to fill volume that remains unused by cartons may be integrated at the time the container is produced or alternatively may be added at a later time, such as during processing before or after filling the cartons, or at any other time prior to sealing of the containers.

A carton or container of the present disclosure may also have an opposed second end which can be closed by an alternate mechanism. An alternate mechanism may be an automatic bottom wherein, when the carton or container is in a closed position the carton or container is substantially flat, and when the carton or container is opened, the front, back, and sidewalls interact so as to automatically close the opposed second end as the carton is opened. This may be accomplished by the sidewalls having a triangle like extension which interacts with the front and back walls, or may instead utilize hook type interactions, or alternatively projections which may be pre-formed to fold inwardly in places as the carton is opened, closing one or both ends of the carton. Other types of automatic bottom containers known in the may be used in the present disclosure.

When an automatic bottom closure is utilized, it may be utilized on an opposed second end of a carton. In this embodiment, the opposed second end of a carton may be opposite the end in which a container may be filled with a product. The opposed second end may have an automatic bottom closure, where the first end of the carton which receives the product may have more traditional flaps which may be closed by machine processes. In yet another embodiment, both ends may be open such that the carton may be filled from both ends. Filling from both ends may happen simultaneously in one embodiment, or may alternatively be used to fill adjacent containers from opposite ends, or may fill from opposite ends in any pattern selected.

Integrated carton and containers as described in any of the proceeding embodiments may be filled by a side load mechanism or by a vertical mechanism. Containers utilizing a side load mechanism may be loaded onto the apparatus on a side such that a first end and second opposed end are facing a horizontal direction. Side load mechanisms may load from either end or both ends. Side load mechanisms filling from both ends may load either simultaneously or in alternating fill patterns. Containers utilizing a vertical load mechanism may be loaded onto the apparatus on a first end or a second opposed end which may be sealed or folded into a closed position with a first end or a second opposed end facing in an upwards direction. Containers utilizing a vertical fill mechanism may only contain a single plurality of cartons or they may contain multiple pluralities of cartons. A container utilizing a vertical fill mechanism may first fill from one end and then another end, or may use any other method which is known in the field.

Cartons for use in the present disclosure may have any flap arrangement known in the art including a traditional four side tuck and fold arrangement. In one embodiment, the cartons may have a flap arrangement such that at least one end may be closed by a mechanical apparatus. In yet a further embodiment, a flap on a leading side of a carton may contain a notch which is sized and positioned such than a mechanical closing mechanism may pass through the notch, leaving the leading side flap closed and instead closing the trailing side flap prior to closing the leading side flap.

A filling apparatus such as a case assembly conveyor for use in the present disclosure may include a section which contains integrated cartons and containers in a closed position. Such a section may include a compressed queue, stack, or sorting section. Alternately, integrated cartons and containers may be loaded, stacked or queued in an alternate mechanism which may be located above or below the case assembly conveyor, or in line with a case assembly conveyer.

A picking mechanism, such as a case picker may be used to place integrated cartons and containers onto an assembly conveyer. Alternatively, mechanisms such as conveyers, lifts, or other picking mechanisms may be used. In yet another embodiment, the integrated cartons and containers may be placed directly onto the case assembly apparatus.

Integrated cartons and containers may be held in an open position on a case assembly conveyer by guide bars. Exterior guide bars may be placed so as to restrain container major flaps, carton exterior major flaps, or both carton and container major flaps. A single interior guide bar or a plurality of interior guide bars may be arranged and used to hold carton interior major flaps parallel to the integrated carton and container so that the carton interior major flaps remain in an open position without obstructing the case assembly apparatus or the filling process. The number and arrangement of the plurality of interior guide bars may be selected based upon the number of rows contained in the integrated carton and container. In this way, interior guide bars may correspond to a single row of cartons or may hold interior major flaps of cartons in two adjacent rows.

A filling apparatus may contain a multi-tiered packer which may fill the integrated cartons and containers with a product or products. A multi-tiered packer may be configured to fill a single product, a plurality of products such as a clip of products, or other arrangements of products. A multi-tiered packer may contain a number of filling elements that corresponds with the number of cartons contained in an integrated carton and container. A multi-tiered packer may be configured to fill every carton contained in an integrated carton and container simultaneously, or may fill individual rows or columns simultaneously. In yet another embodiment, a multi-tiered packer may fill from opposing sides of the integrated carton and container simultaneously or alternating one side and then the other. A multi-tiered packer may be configured to fill with a side-load mechanism or may be configured to fill from a top-load or vertical mechanism.

A filling apparatus may contain a plurality of different closing mechanisms for closing carton and container flaps, or alternatively may only use a single closing mechanism or two different closing mechanisms. Mechanisms used in closing carton and container flaps include fold bars, pin wheel kickers, and guide rail transitions, and the like. Guide rails transitions may be used in one embodiment to close carton and container major flaps where fold bars or pin wheel kickers are used to close carton and container minor flaps. Other closing or folding mechanisms or different combinations of closing to mechanisms may be used.

Various embodiments of the present disclosure will now be described in more detail.

Figure 2:
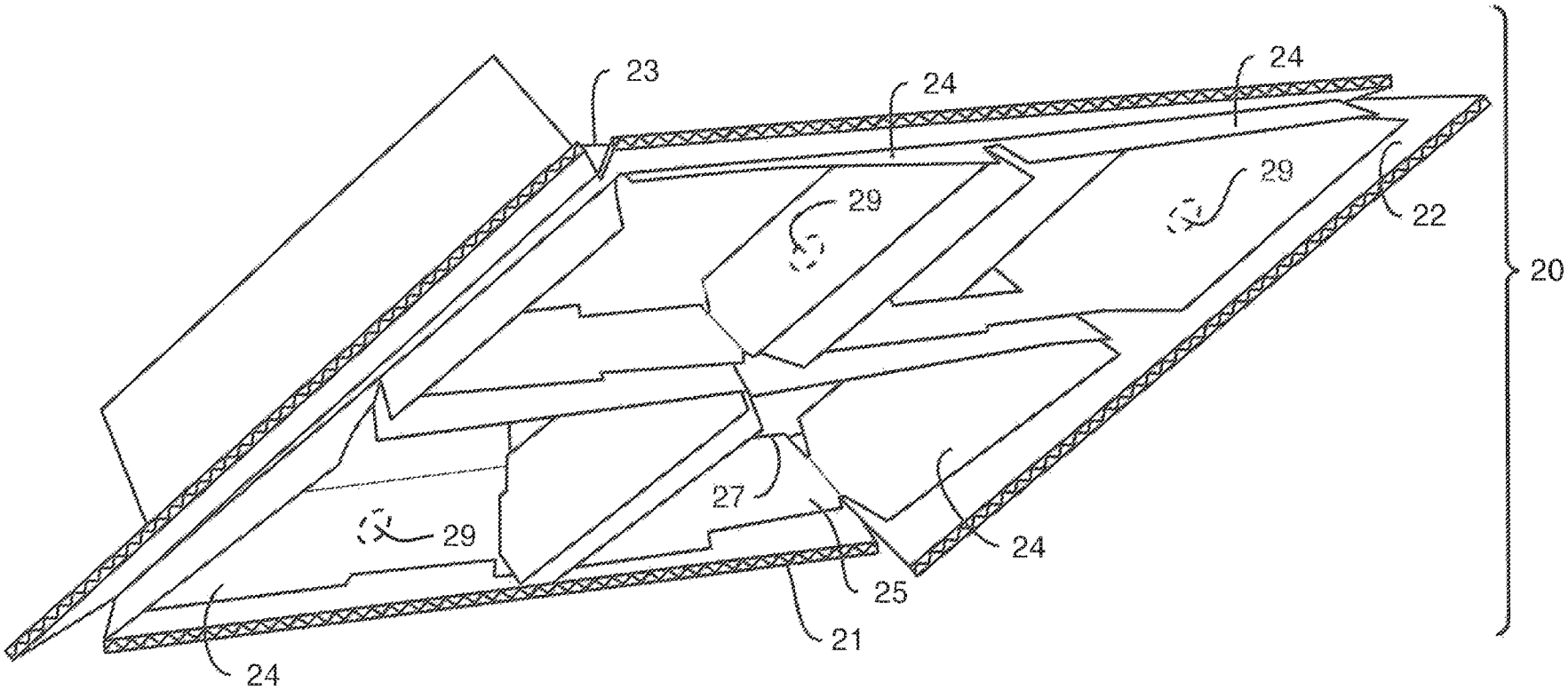
FIG. 2 is a view of an integrated carton and container in a partially open position.

FIGS. 1-3 refer to one embodiment of the present disclosure. FIG. 1 shows the integrated carton and container of this embodiment in a substantially flat collapsed or folded position. Integrated carton and container 20 includes container 22 and carton 24. When integrated carton and container 20 is in a folded or collapsed position, the integration between carton and container is maintained. Container 22 may be a box, package, parcel, pack, or other container which may be used for the purposes of the present disclosure. A container such as container 22 or a carton such as carton 24 may be made or cardboard, fiberboard, paperboard, corrugated fiberboard, cardboard, or paperboard, metals, plastics, either rigid or flexible, and the like. Container 22 may be integrated with cartons 24 at an initial production step or cartons 24 may be integrated at a later time.

FIG. 2 shows FIG. 1 transitioning from a folded position to an open position. In an embodiment such as FIG. 2, all or a portion of the cartons 24 may be attached to container 22 in such a way that the cartons 24 may transition into an open position as container 22 is transitioned into an open position. Container 22 may have a first end 21 and an opposed second end 23, and cartons 24 may have a first end 25 and an opposed second end 27. Potential points of attachment 29 are marked by the dotted areas, and show areas which may contain a releasable attachment composition on an exterior side of a carton or an interior side of the container. As shown in FIG. 2, in some embodiments, none of the cartons may be attached to another carton, and instead some or all of the cartons may be attached to the container. In alternative embodiments, some or all of the cartons may be attached to another carton.

FIG. 3 shows the embodiment of FIG. 1 in a fully open position. Cartons 24 may also be in an open position such as shown in FIG. 3 when container 22 is in an open position. In this embodiment none of the cartons may be attached to another carton, instead, points of attachment 29, are only on a first sidewall of a container 31 and an opposed second sidewall of a container 33. In an embodiment which is not shown, each row between the first sidewall 31 and second sidewall 33 may have a releasable attachment between each and every carton in the row and between the container and cartons within the row which are adjacent to the first sidewall and opposed second sidewall. In this manner, the row will not have any cartons with a first sidewall or opposed second sidewall that is unattached to either an adjacent carton in the row or to a container first sidewall or second opposed sidewall in line with the row, but none of the cartons will have a point of attachment to a carton in another row.

Figure 4:
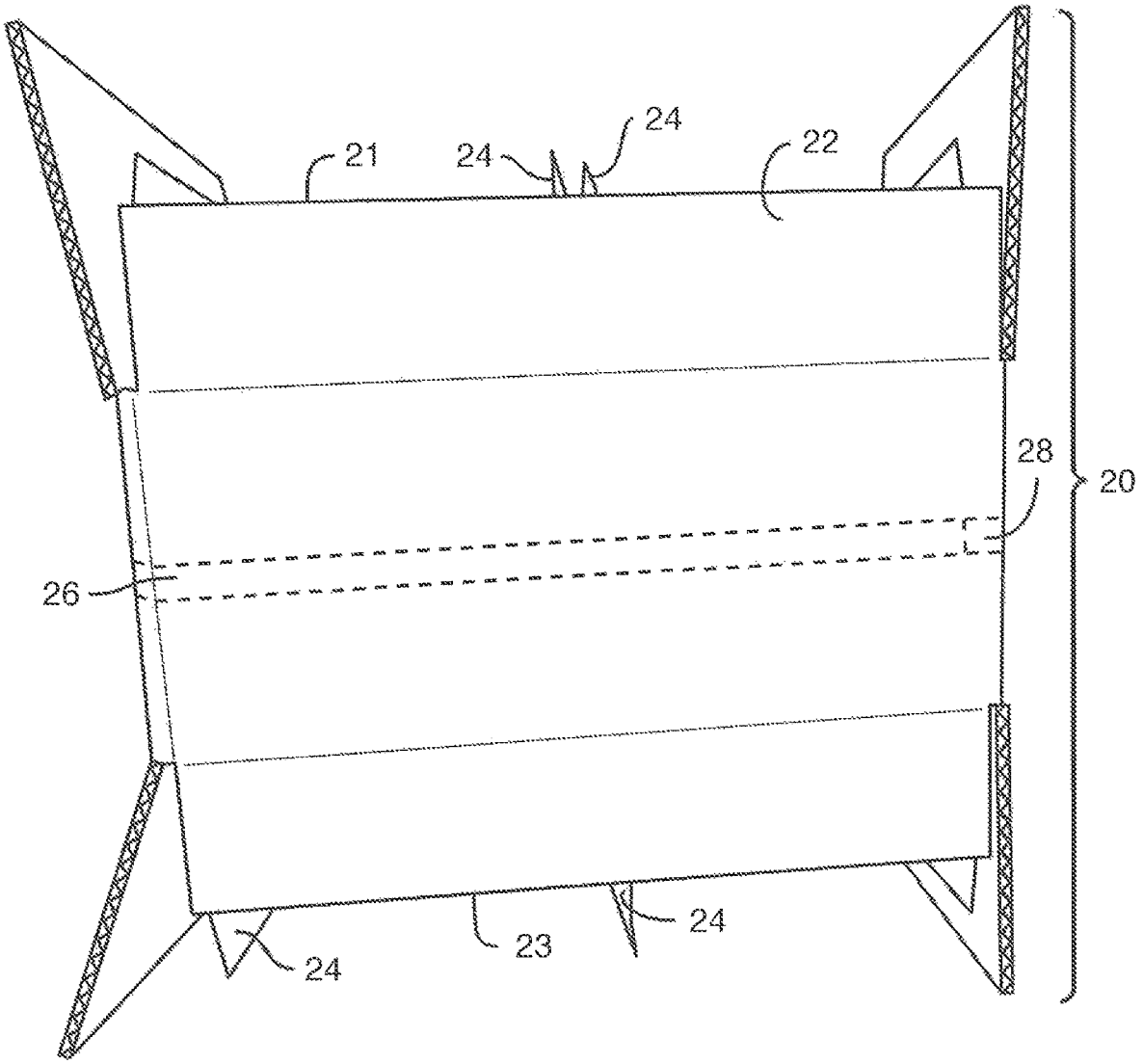
FIG. 4 is a side view of an integrated carton and container in an open position.

FIG. 4 shows a side view of an embodiment of an integrated carton and container 20. Container 22 contains a perforated strip 26 which may have a punch tab 28. The punch tab 28 may be pressed in, separating the tab 28 from the container 22 such that the tab 28 may be grasped. Perforated strip 26 may be separated from container 22 by grasping the tab 28 and pulling the strip around the container 22, separating container 22 into two pieces. Tab 28 and strip 26 are shown in a generally centered position on container 22, but the strip or tab may be positioned in any location on the container 22. For example, in an embodiment where the container 22 is also intended to be used as a store display, strip 26 may be near a top side of a container 22 so that a top section may be removed while still providing support to cartons 24. In yet a further embodiment, a strip 26 may be located near a bottom side of a container 22 such that when the container is separated, it may be easier to remove containers 24.

A punch tab such as tab 28 which is not shown may also be separated from the box such that it can be grasped without pressing in or may alternatively only a portion of the tab may need to be pressed in such as a finger punch so that the rest of the tab may be pulled in direction away from a container 22. A strip which is not shown may be releasably attached to the interior of a container 22 by an adhesive or other attachment composition instead of being perforated. A strip, which is releasably attached to the interior of a container 22, may be separated from the cartons 24 and/or container 22 so as to remove any releasable adhesive and release the cartons 24 from the container 22. Alternatively, the strip may separate the cartons 24 from the container 22 without removing any of the releasable adhesive.

Figure 5:
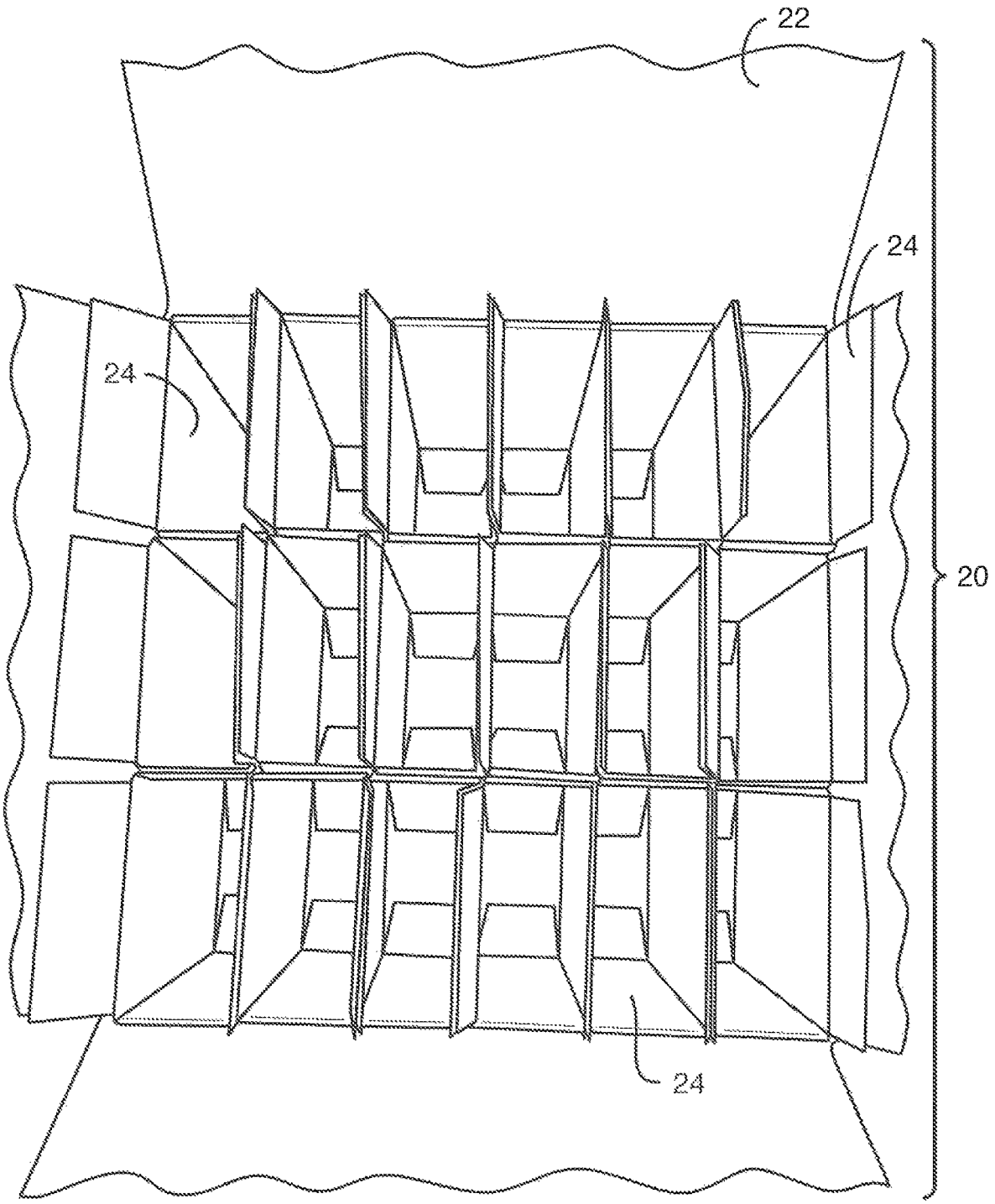
FIG. 5 is a view of an alternative embodiment of an integrated carton and container.

An alternative embodiment of the integrated carton and container 20 of the present disclosure may be shown in FIG. 5. While earlier embodiments have shown a container integrated with four cartons arranged in two rows and two columns, a container may be integrated with any number of cartons in any arrangement of rows and columns. FIG. 5 shows an embodiment in which eighteen cartons 24 have been integrated into container 22 and are arranged in six columns and three rows. In a further embodiment, the number of cartons may correspond to the product of which the cartons will be holding or more particularly the machine used for packing or filling that product. For example, the number of cartons may be selected based upon the capacity of the packer apparatus to be used for a particular product.

Figure 6:
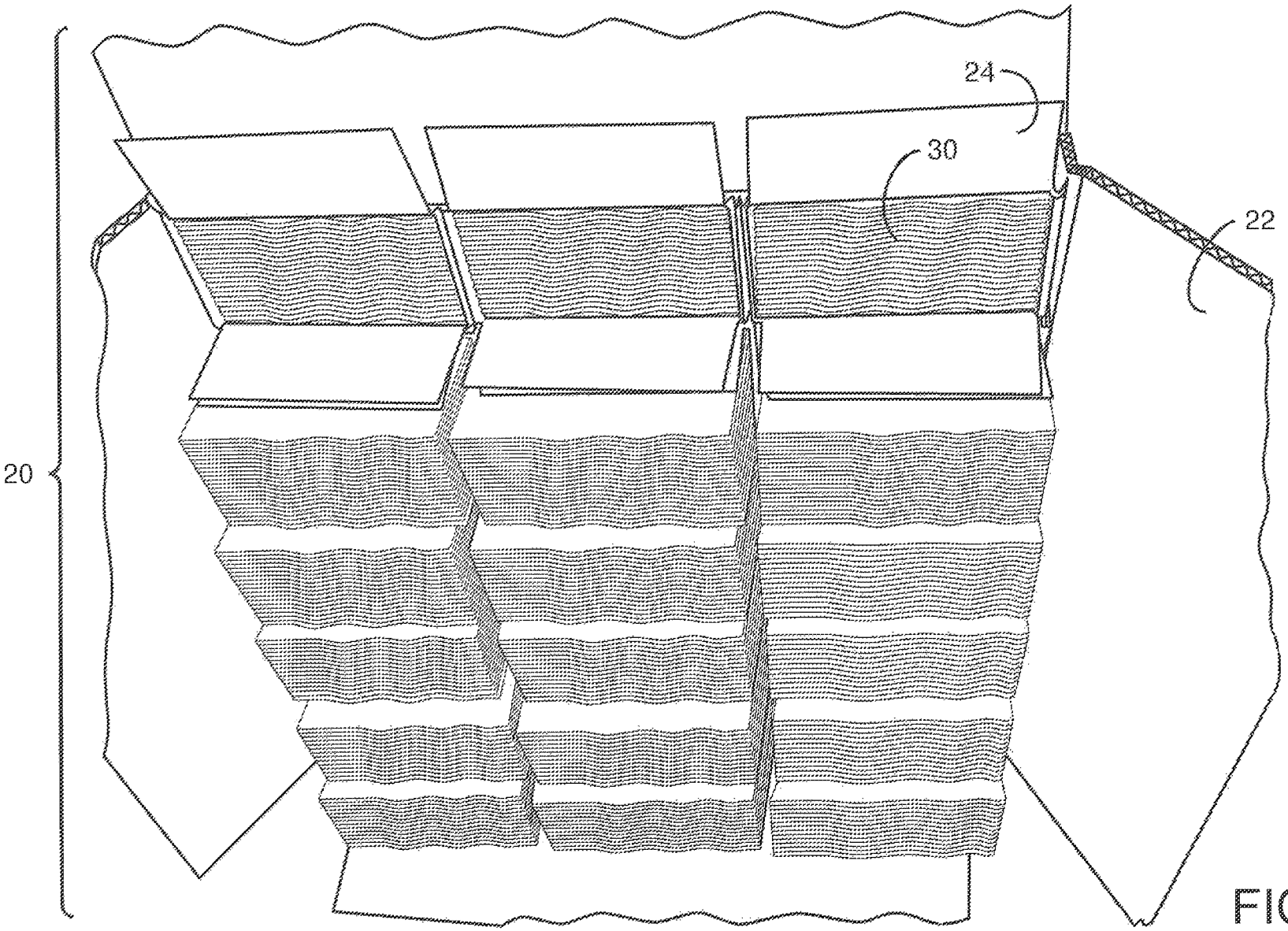
FIG. 6 is a view of an integrated carton and container containing a product.

FIG. 6 shows an embodiment similar to that of the embodiment of FIG. 5 except that the arrangement of the cartons has been altered and the cartons have been filled with a product. The integrated container and carton 20 comprises a container 22 which is integrated with eighteen cartons 24 arranged in three columns and six rows, and each carton 24 has been filled with a product 30. The product 30 may be a paper product as shown in FIG. 6, or may be any other product that may be packed or filled using a carton filling apparatus. For example, other products may include bottled products, feminine care products, hygiene products, cleaning or sanitary wipes, diapers or incontinence products, or the like. Products for use in cartons of the present disclosure may be packed singularly in a carton or may be packed with more than one item per carton.

The present disclosure may also be generally directed to a method for filling and closing an integrated container and carton. FIGS. 7 through 13 show one embodiment of a method and apparatus for filling and closing an integrated carton and container.

Figure 7:
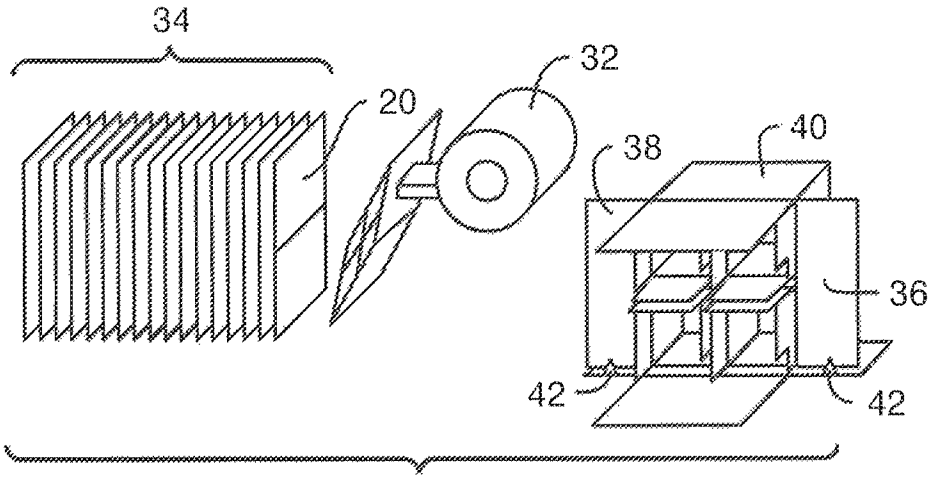
FIG. 7 is a view showing an integrated carton and container being placed on a processing apparatus.

FIG. 7 shows a step of placing an integrated carton and container 20, such as a carton and container shown in FIGS. 1-3, onto a case assembly apparatus or similar apparatus. A picking apparatus 32 suitable for picking or taking an integrated carton and container 20 from a queue 34 may be utilized to place an integrated carton and container on a case assembly apparatus. In alternative embodiments, containers may be placed on an apparatus using other mechanisms such as conveyors, lifts, or any other mechanism suitable in the art. When an integrated carton and container 20 is placed on a case assembly apparatus, container 22 may have a leading side minor flap 36 and a trailing side minor flap 38. The leading side minor flap 36 and trailing side minor flap 38 may be pulled back from their natural position such that they may be substantially perpendicular to the container body 40. The leading side minor flap 36 and trailing side minor flap 38 may be held back by a releasable attachment mechanism 42 which may include a clip, finger, or notch for example.

Figure 8:
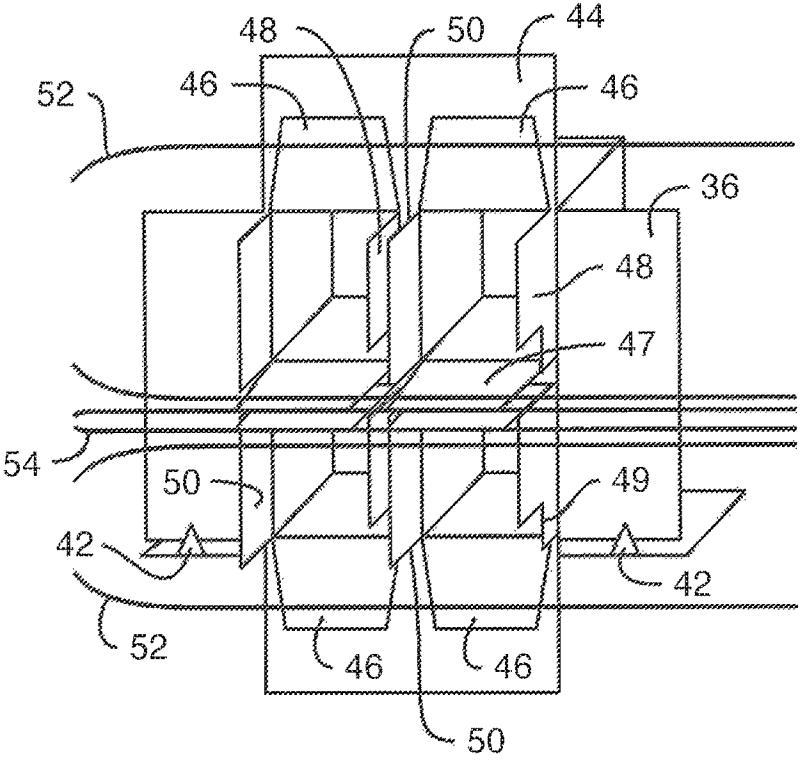
FIG. 8 is a view showing an integrated carton and container being held in an open position in a processing apparatus.

FIG. 8 is a close-up view of the second portion of FIG. 7 and further shows a method for holding container major flaps 44, carton exterior major flaps 46, carton interior major flaps 47, carton leading side minor flaps 48, and carton trailing side minor flaps 50 in an open position using exterior guide bars 52 and interior guide bars 54. Exterior guide bars 52 may be used in one embodiment to hold back container major flaps 44 and carton exterior major flaps 46, in this embodiment, a curve at a beginning portion of exterior guide bar 52 may be used to pull back container major flaps 44 and carton exterior major flaps 46 into a substantially perpendicular position to the container body 40. In an embodiment, interior guide bars 54 may contain a "y" or "V" or "u" like opening at a beginning portion of the interior guide bars which may aid in receiving a carton interior major flap 47 and holding a carton interior major flap 47 in a substantially parallel position to container body 40. While FIG. 8 portrays an embodiment of the present disclosure, other restraining systems known in the art may be used in the present disclosure. In an embodiment such as the embodiment shown in FIG. 5, a carton may have no exterior major flaps and may only have interior major flaps. In such an embodiment, such as where a carton is located in an interior row, the carton major flaps may be held open by more than one interior guide bar, and has no flaps which are held open by exterior guide bars.

Figure 9:
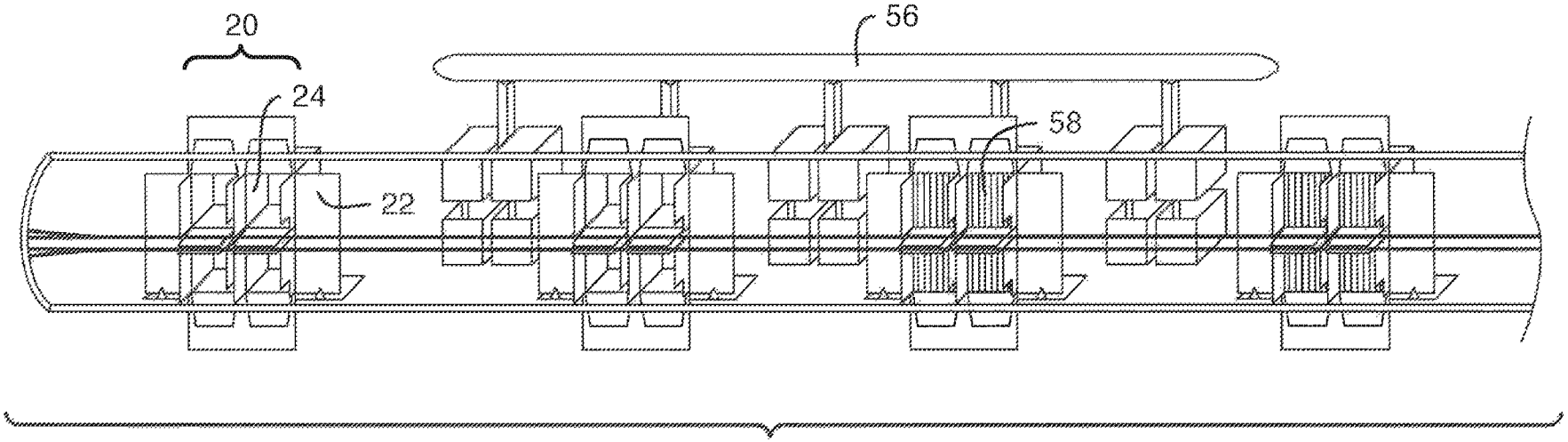
FIG. 9 is a view showing a portion of a processing apparatus wherein an integrated carton and container is filled by a filling mechanism.

FIG. 9 shows a step of the process in which integrated carton and containers 20 are filled with a product 58. Integrated carton and containers 20 may be filled with a product 58 while cartons 24 are integrated in container 22 by using an apparatus such as a multi-tiered packer 56. Multi-tiered packer 56 may fill multiple cartons 24 in a single or multiple containers simultaneously. As previously disclosed, while FIG. 9 shows an embodiment with four cartons arranged in two rows and two columns being loaded simultaneously, a number and arrangement of cartons may be selected based upon the capacity of multi-tiered packer 56. One embodiment may utilize a number of cartons which corresponds to the number of available loading units on a multi-tiered packer.

Figure 11:
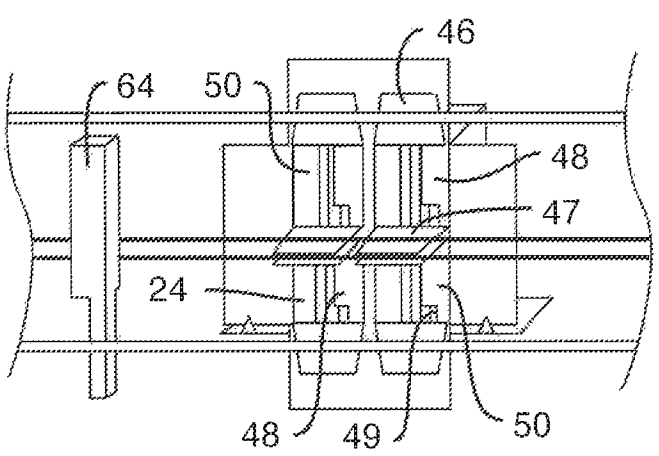
FIG. 11 is a view showing a mechanism for closing flaps on a leading edge of a carton.
Figure 10:
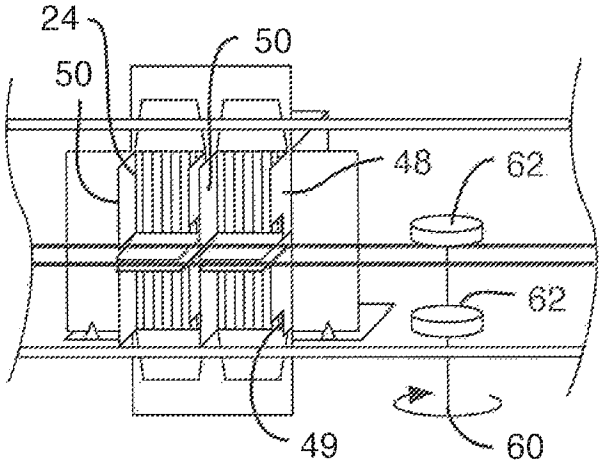
FIG. 10 is a view showing a mechanism for closing flaps on a trailing edge of a carton.

As shown in FIGS. 10-11, an integrated carton and container of the present disclosure may contain cartons 24 which have a notch 49 on a carton leading side minor flap 48. The notch may be positioned and sized to allow a closing mechanism such as a pin wheel kicker 60, to pass through the notch, leaving carton leading side minor flap 48 in an open position and closing carton trailing side minor flap 50. While FIG. 10 shows an embodiment using a pinwheel kicker 60 to close a carton flap, other closing means known in the art may be used and may also be chosen and positioned to utilize a notch, or may alternately utilize a different closing mechanism. Further, FIG. 10 portrays an embodiment wherein the pinwheel kicker 60 comprises two closing components 62, in a further embodiment, the pinwheel kicker 60 may have a higher number of closing components or alternatively only a singular closing component. The number of closing components 62 may be chosen based upon the number of rows of cartons 24 to be closed in an integrated carton and container 20. For example, in an alternative embodiment, pinwheel kicker 60 may comprise a number of closing components 62 such that each row of cartons may be closed by an individual closing component 62.

FIG. 11 shows a view of the process in which both the carton trailing side minor flaps 50 and the carton leading side minor flaps 48 have been closed by one closing mechanism or separate closing mechanisms. For example, an embodiment according to FIG. 11 shows that a folding bar 64 closing mechanism has closed carton leading side minor flap 48. While a folding bar such as folding bar 64 is shown in the current embodiment, other closing mechanisms may be used, and in one embodiment both carton leading side minor flaps and carton trailing side minor flaps may be closed by pin wheel kickers or the like, or alternatively different closing mechanisms may be used for the leading side and trailing side flaps.

Figure 12:
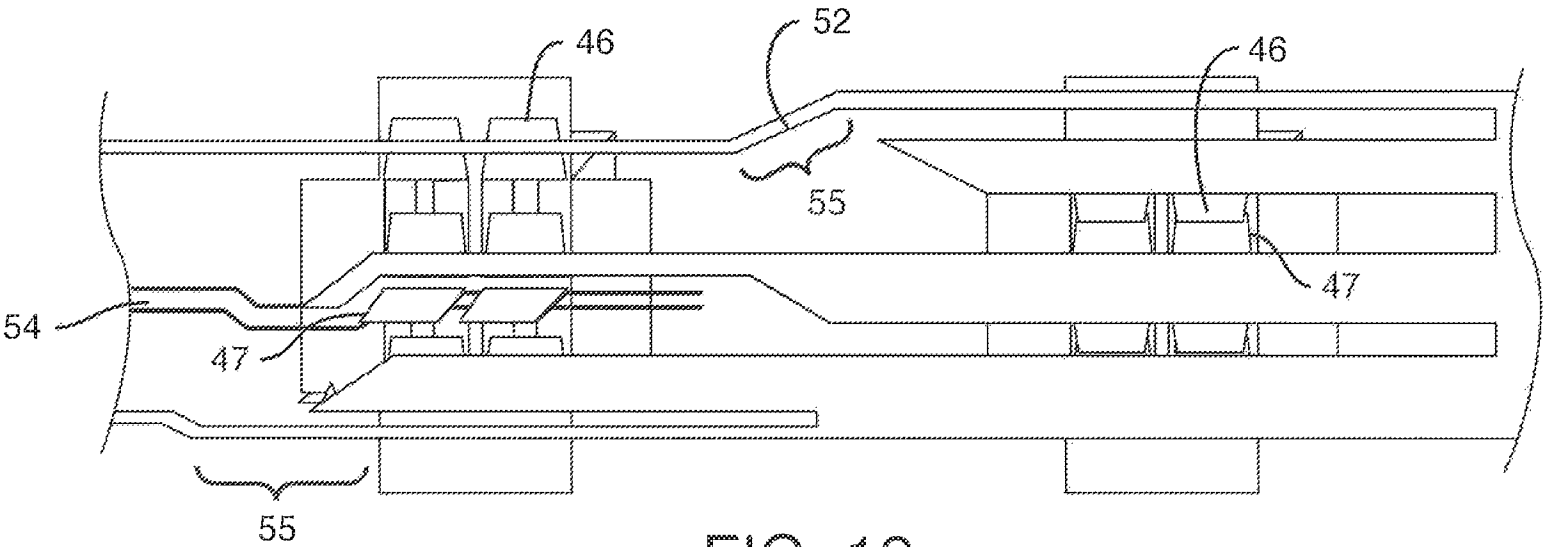
FIG. 12 is a view showing a mechanism for closing flaps major flaps of a carton.

FIG. 12 shows a view of the process in which the carton leading side minor flaps 48 and the carton trailing side minor flaps 50 are in a closed position. Guide rail transitions 55 of interior guide rails 54 and exterior guide rails 52 may fold carton exterior major flaps 46 and carton interior major flaps 47 into a closed position. While FIG. 12 shows an embodiment where the minor flaps have been closed prior to the major flaps, there is no such restriction and in alternative embodiments the major flaps (46, 47) may be closed prior to the minor flaps (48, 50), and in yet a further embodiment, the flaps may be closed in an alternating arrangement such that a minor flap is closed, followed by a major flap, and then a second minor flap, and ending with a second major flap. Any fastening mechanism may be used to hold the carton flaps in a closed position such as an adhesive, pressure sensitive adhesive, hook and notch, or any other closure mechanism known in the art.

Figure 13:
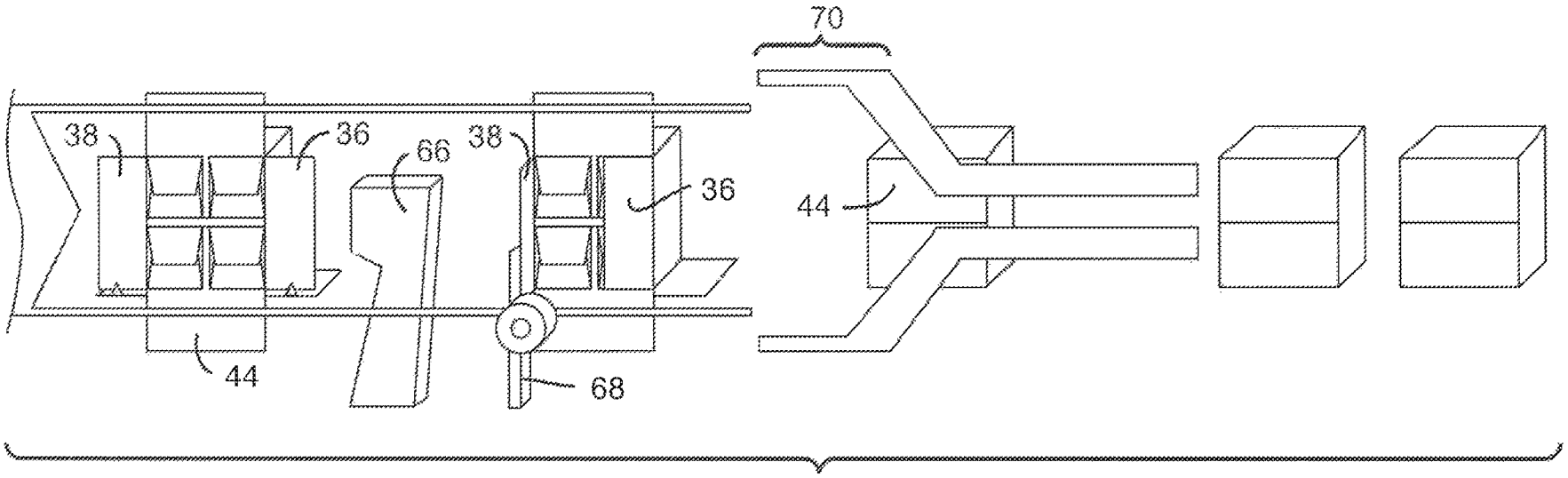
FIG. 13 is a view showing a mechanism for closing container flaps.

FIG. 13 shows a step of the process wherein the container major and minor flaps are closed after the carton flaps have been closed. FIG. 13 shows that a container leading edge minor flap 36 is closed using a second folding bar 66. A spinning wheel 68 is then used to close the container trailing edge minor flap 38. A second set of guide rail transitions 70 may close container major flaps 44. Any fastening mechanism may be used to hold the container flaps in a closed position such as an adhesive, pressure sensitive adhesive, hook and notch, or any other closure mechanism known in the art. While FIGS. 7-13 have shown an embodiment wherein the carton flaps are closed prior to the container flaps, in an alternative embodiment, the carton and container flaps may be closed at the same time, or may alternate closing some carton flaps, and then some container flaps, until all flaps are closed.

FIGS. 7-13 have only shown a single view of the cartons and containers, but, the same or similar process may be conducted simultaneously on the opposing side. Or in an alternate embodiment, the opposing side is closed prior to filling either by an automatic bottom type closure, a more traditional closure on a case assembly apparatus, or the closing process embodied in FIGS. 7-13 may be done in advance of filling or concurrently with the filling process.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. An integrated carton and container comprising:

a collapsible container, the container including sidewalls, a first end and an opposite second end, the container defining an interior volume;

a plurality of collapsible cartons, each carton including at least one sidewall, a first end, an opposite second end, wherein the first end has a flap and the second end has a second flap, each carton including a folded position and an open position and wherein, when in the folded position, the carton is substantially flat, and wherein, when in the open position, the carton is in an expanded position defining an interior volume, the plurality of collapsible cartons being arranged and positioned in the interior volume of the container such that the at least one sidewall of each carton is parallel with at least one of the sidewalls of the container; and wherein at least some of the cartons are releasably attached to the container or to an adjacent carton in a manner that integrates the cartons to the container such that when the container is in a collapsed position, all of the cartons are in the folded position and when the container is transitioned from the collapsed position to an open position, all of the cartons similarly transition from the folded position to the open position.

2. An integrated carton and container as defined in claim 1, wherein all of the cartons are positioned within the container such that the first end of each and every carton faces the first end of the container.

3. An integrated carton and container as defined in claim 1, wherein the container includes at least two rows of cartons and at least two columns of cartons.

4. An integrated carton and container as defined in claim 3, wherein the container includes at least three rows of cartons and at least three columns of cartons.

5. An integrated carton and container as defined in claim 1 wherein every carton has at least one point of releasable attachment to the container or to an adjacent carton.

6. An integrated carton and container as defined in claim 5 wherein every carton that is adjacent to a container sidewall has at least one point of releasable attachment to a container sidewall.

7. An integrated carton and container as defined in claim 1 wherein the container has a first sidewall and a second opposed sidewall, and each carton has a first sidewall and a second opposed sidewall, and each carton has two points of releasable attachment, wherein a first point of releasable attachment is between the first sidewall of a carton and the first sidewall of the container or the second sidewall of an adjacent carton, and a second point of releasable attachment is between the second sidewall of a carton and the second sidewall of the container or the first sidewall of an adjacent carton.

8. An integrated carton and container as defined in claim 1, comprising a second plurality of collapsible cartons positioned within the container, each of the cartons in the second plurality including at least one sidewall, a first end, and a second and opposite end, and wherein the second end of the first plurality of cartons faces the second end of the second plurality of cartons within the container such that the first end of each carton in the second plurality of cartons faces the second end of the container.

9. The integrated carton and container of claim 1 wherein the second end of each carton is configured to close automatically when the container is transitioned from a collapsed position to an open position.

10. The integrated carton and container of claim 1 wherein each carton has flaps that close each carton and the container has flaps that close the container.

11. The integrated carton and container of claim 1 wherein some or all of the cartons are filled with a product or products.

12. A method for filling and closing an integrated carton and container comprising:

placing the integrated carton and container according to claim 1 on a case assembly apparatus, holding the container and the carton or cartons in an open position, filling some or all of the cartons with a product or products, closing the carton or cartons, and closing the container.

13. A method for filling and closing an integrated carton and container of claim 12 further comprising the steps of attaching a container leading side minor flap and a container trailing side minor flap to a releasable attachment mechanism and holding the container leading side minor flap and container trailing side minor flap in an open position.

14. A method for filling and closing an integrated carton and container of claim 12 further comprising the steps of using guide bars to hold container major flaps, a carton exterior major flap, and a carton interior major flap in an open position, and using guide bar transitions to close the container major flaps, the carton interior major flap, and the carton exterior major flap.

15. A method for filling and closing an integrated carton and container of claim 12 further comprising the steps of:

having a carton leading side minor flap, the carton leading side minor flap having a notch sized and positioned to correspond with a closing mechanism, remain in an open position when a closing mechanism passes through the notch, closing a carton trailing side minor flap, and then closing the carton leading side minor flap.

16. A method for filling and closing an integrated carton and container of claim 12 further comprising the step of filling the integrated carton and container with a product or products using a side load mechanism.

17. A method for filling and closing an integrated carton and container of claim 12 further comprising the step of filling the integrated carton and container from a the first end and an opposed second end of the container.

18. A method for filling and closing an integrated carton and container of claim 12 further comprising the step of filling the integrated carton and container using a vertical load mechanism.

19. A method for filling and closing an integrated carton and container of claim 12 wherein the product comprises facial tissues.

20. A method for filling and closing an integrated carton and container of claim 12 wherein the product comprises feminine care products.

* * * * *